US007517263B1

(12) United States Patent
Shen et al.

(10) Patent No.: US 7,517,263 B1
(45) Date of Patent: Apr. 14, 2009

(54) ADVANCED BLADE SECTIONS FOR HIGH SPEED PROPELLERS

(75) Inventors: Young T. Shen, Potomac, MD (US); Scott D. Black, Vienna, VA (US); Stuart D. Jessup, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/900,135

(22) Filed: Sep. 5, 2007

(51) Int. Cl.
*B63H 1/18* (2006.01)

(52) U.S. Cl. ..... 440/66; 416/223 R

(58) Field of Classification Search ..... 440/66, 440/274, 278; 416/223 R, 237, 243; 114/274, 114/278

See application file for complete search history.

(56) References Cited

U.S. PATENT DOCUMENTS 3,065,723 A 11/1962 Tulin
3,077,173 A * 2/1963 Lang ..... 114/278
4,073,601 A * 2/1978 Kress ..... 416/223 R
4,865,520 A * 9/1989 Hetzel et al. ..... 416/237
5,551,369 A 9/1996 Shen
5,601,047 A * 2/1997 Shen ..... 114/274

OTHER PUBLICATIONS

Young T. Shen, Scott D. Black, Stuart D. Jessup, Advanced Blade Sections for High Speed Propellers; Society of Naval Architects and Marine Engineers 11th Propellers & Shafting Symposium, Sep. 12, 2006, Virginia Beach, VA.

* cited by examiner

*Primary Examiner*—Lars A Olson
(74) *Attorney, Agent, or Firm*—Dave A. Ghatt

(57) ABSTRACT

A method and apparatus is directed towards an advanced blade section for propellers that allow watercrafts to effectively travel in both sub-cavitating and super-cavitating modes. The advanced blade section includes a streamlined profile having a convex upper surface and a lower surface that includes both a convex portion and a concave portion. When the propellers are rotated in a first direction at low speeds to propel the watercraft in the forward direction, the advanced blade section experiences a fully wetted flow over both the upper and lower surfaces at low speeds. At high speeds, the advanced blade section experiences a partially wetted flow, with only a front part of the lower surface being fully wetted, at high speeds. When the propellers are rotated in a second direction opposite the first direction to reduce the speed of the watercraft, the blade section experiences a substantially wetted flow over both upper and lower surfaces.

19 Claims, 7 Drawing Sheets

ADVANCED BLADE SECTIONS FOR HIGH SPEED PROPELLERS

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for propelling watercrafts at high speeds, more particularly, to advanced blade sections for propellers that allow watercrafts to effectively travel in both sub-cavitating and super-cavitating modes.

BACKGROUND

Historically, naval and commercial watercrafts were typically operated in the speed ranges of 10 to 30 knots plus. Because of developments in hydrodynamic theories of ship resistance and hull form design, ships that travel at speeds greater than 30 knots are now available. Based on this technology, the Navy has been developing high speed ships with sprint/transient speeds of 38 to 45 knots. The private sector is also actively pursuing the development of high-speed ships such as fast ferryboats that can travel at about 40 to 50 knots. Along with the increased capacity for speed comes the demand for efficient propulsors for high-speed ships.

For good propeller performance, conventional propellers are designed to operate without blade surface cavitation. This type of propeller is termed a sub-cavitating propeller. A typical blade section 100 for sub-cavitating propellers is shown in FIG. 1A. As shown, the blade section 100 is substantially streamlined from the leading end 110 to the trailing end 120. Operating in a ship wake with an inclined shaft, the blade surfaces of these propellers typically start to experience surface cavitation between 25 and 29 knots. Increasing the ship speed by more than 5 knots above the surface cavitation inception speed typically results in severe propeller cavitation. Severe cavitation typically results in the loss of propeller efficiency, erosion, and thrust breakdown.

As shown in FIG. 1A, marine propellers have historically utilized blade sections with airfoil shapes having known cavitation characteristics. At high speeds, these sections will begin to cavitate either at their leading edge due to angle of attack fluctuations, or in the middle of the upper surface due to the low pressure. As blade surface cavitation grows with increasing speed, it eventually covers the entire upper side of the blade. When this occurs, the blade is considered to be operating in the super-cavitating condition. The upper surface of the blade section is covered by a vapor or ventilated air cavity starting at the leading edge and extending to and beyond the trailing edge. In that condition, the hydrodynamic loading is totally controlled by the pressure surface blade profile. Unfortunately, the shape of a pressure face designed for sub-cavitating operation is usually not effective for producing lift in the full cavitating mode.

A super-cavitating foil typically has a sharp leading edge, where surface cavitation is intentionally initiated. A sample super-cavitating blade section 150 is shown in FIG. 1B. As illustrated, the super-cavitating blade section 150 has a sharp edge at the leading end 160 and a blunt edge at the trailing end 170. The hydrodynamic efficiency (lift-to-drag ratio) of a foil operating in a super-cavitating mode is governed by the lower surface camber. However, when super-cavitating foils are used in sub-cavitating conditions, the blunt trailing edge of the section produces a significant separated flow which results in high drag.

Consequently, it is desired to have a foil that operates effectively in both sub-cavitating and super-cavitating flow regimes. U.S. Pat. No. 5,551,369 discloses a duel-cavitating foil. However, U.S. Pat. No. 5,551,369 is directed towards hydrofoils, which can be controlled mechanically by directly changing the angle of the foils or by using flaps. Without a controllable pitch mechanism, this is not a viable option for propeller systems.

Additionally, propellers are now used to produce negative thrust to slow down and stop watercrafts. Two methods are currently used to achieve negative thrusts. One method is to use a controllable pitch device to rotate the propeller pitch to generate negative thrust. The challenge of using this method is that it is costly to fabricate, it requires a large space to house the controllable pitch mechanical device, and it is a maintenance challenge.

Another method is to reverse the propeller's rotational direction. With the recent advance in electric motor technology, the polarity of electric current can be easily switched to reverse propeller shaft and RPM direction to generate large negative thrust for emergency stopping. However, with conventional super-cavitating propellers, when a propeller RPM is operated in a reverse direction, the flow reverses and flows from the trailing edge toward the leading edge. As shown in FIG. 1B, the trailing end of conventional super-cavitating foils are blunt, which produces significant flow separation. Consequently, it is desired to have a propeller foil that operates effectively in a super-cavitating flow regime and is able to produce emergency stopping.

SUMMARY

In one aspect, the invention is a watercraft having a hull and one or more propulsion units attached to the hull. The invention further includes one or more propeller blades rotatably mounted to each of the one or more propulsion units for operating in a sub-cavitating mode and a super-cavitating mode. In this aspect, the blade includes an advanced blade section. The advanced blade section includes an upper surface and a lower surface. The upper surface and the lower surface intersect at a forward end and at an aft end. The forward end has a forward edge and the aft end has an aft edge. According to the invention, the upper surface includes an upper convex portion extending from the forward end to the aft end. Additionally, the lower surface includes a lower convex portion and a lower concave portion. The lower concave portion and the lower convex portion intersect at a central zone between the forward end and the aft end. In this aspect, the upper and lower surfaces function to provide fully wetted flow over both the upper and lower surfaces at low speeds, and a partially wetted flow with only a front part of the lower surface being fully wetted, at high speeds.

In another aspect, the invention is a method of accelerating and decelerating a water vessel in open water through sub-cavitating and super-cavitating modes. The method includes the providing of a water vessel having a hull and one or more propeller blades. According to the method, each blade has an advanced blade section having an upper surface and a lower surface that intersect at a leading end and at a trailing end. The leading end has a leading edge and the trailing end has a trailing edge. The method includes the accelerating of the water vessel through a sub-cavitating mode by rotating the one or more propeller blades at accelerated angular velocities in a first direction. In the first direction, water flows from the leading edge to the trailing edge, and in the sub-cavitating mode both the upper and lower surfaces are fully wetted and have a fully attached boundary layer flow. The method further includes the accelerating of the water vessel through a super-cavitating mode. This is performed by rotating the one or more propeller blades at accelerated angular velocities in the first direction. In the super-cavitating mode only a front part of the lower surface is fully wetted. The method further includes the decelerating of the water vessel to reduce the speed of the vessel or to substantially stop the vessel. This is accomplished by producing a negative thrust by rotating the one or more propeller blades in a second direction opposite the first direction. In the second direction the water flows from the trailing edge to the leading edge in a smooth attached manner.

In yet another aspect, the invention is one or more propeller blades for a watercraft propulsion device for operating in a sub-cavitating mode and a super-cavitating mode. In this aspect, the one or more blades include an advanced blade section having an upper surface and a lower surface. The upper surface and the lower surface intersect at a leading end and at a trailing end. In this aspect, the leading end has a leading edge and a leading edge radius defining the leading edge, and the trailing end has a trailing edge. In this aspect, the upper surface has an upper convex portion extending from the leading end to the trailing end. The upper surface is defined by a maximum half thickness of the upper convex portion and the chord-wise positioning of the maximum half thickness between the leading edge and the trailing edge. The lower surface has a lower concave portion and a lower convex portion forming a transition region, the lower concave portion defined by the leading edge radius, and a super-cavitating contour height of the concave portion. The lower convex portion is defined by a bevel radius of the lower convex portion, a height of the lower convex portion, and chord-wise positioning of the lower convex portion. In this aspect, the lower concave portion and the lower convex portion intersect at a central zone between the leading end and the trailing end.

BRIEF DESCRIPTION OF THE DRAWINGS

Other features will be apparent from the description, the drawings, and the claims.

DETAILED DESCRIPTION

Figure 2:
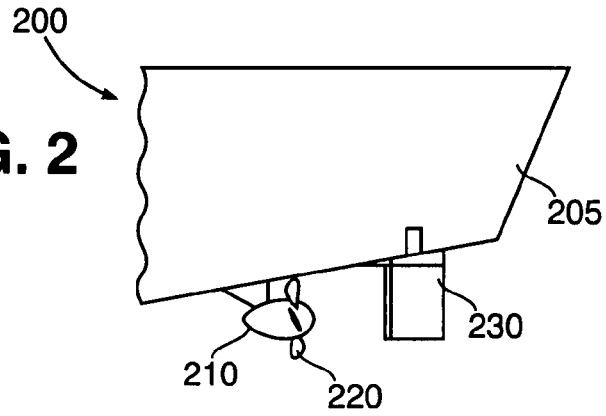
FIG. 2 is a representation of a watercraft having a propulsion system according to an embodiment of the invention.

FIG. 2 is a representation of a watercraft 200 according to an embodiment of the invention. As shown, the watercraft includes a hull 205, a propulsion unit 210 equipped to provide thrusting forces on the watercraft in forward and reverse directions. The propulsion unit 210 includes one or more propeller blades 220. The blades 220 are mounted on a propeller shaft on the unit that facilitates rotation in a first direction, and in a second direction opposite the first direction. FIG. 2 also illustrates a rudder 230 located downstream of the propeller. Although only one propulsion unit 210 is illustrated, the watercraft may include two or more units, as required.

Figure 3A:
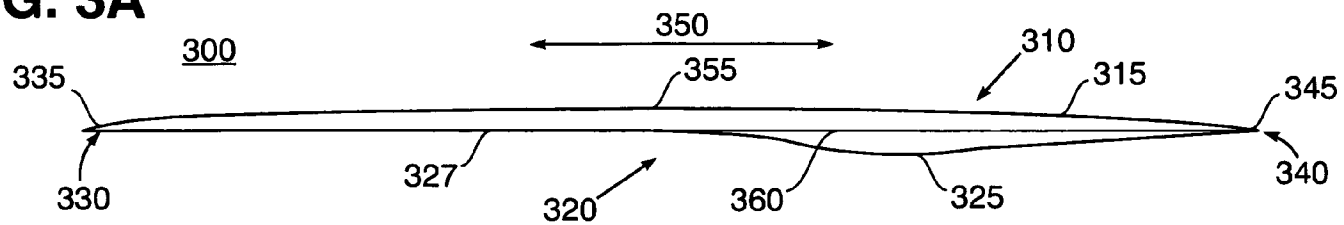
FIG. 3A is a representation of an advanced blade section for operating in both sub-cavitating and super-cavitating modes, according to an embodiment of the invention.

FIG. 3A is a representation of a blade section 300 of a propeller for operating in both sub-cavitating and super-cavitating modes, according to an embodiment of the invention. As shown, the blade section 300 includes an upper surface 310 and a lower surface 320. In operation, when fluid is flowing over the one or more propellers, the upper surface becomes a suction side and the lower surface becomes a pressure surface, with the pressure differences between the sides contributing to the production of lifting and thrusting forces. FIG. 3A also shows a forward or leading end 330, and an aft or trailing end 340. The upper surface 310 and the lower surface 320 intersect at both the forward end 330 and the aft end 340.

Figure 1A:
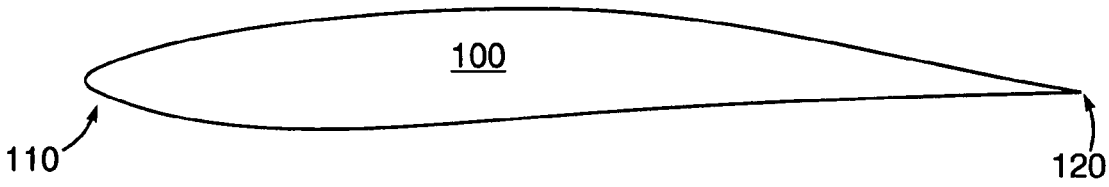
FIG. 1A is a prior art representation of a conventional blade section for propellers operating in a sub-cavitating mode.
Figure 1B:
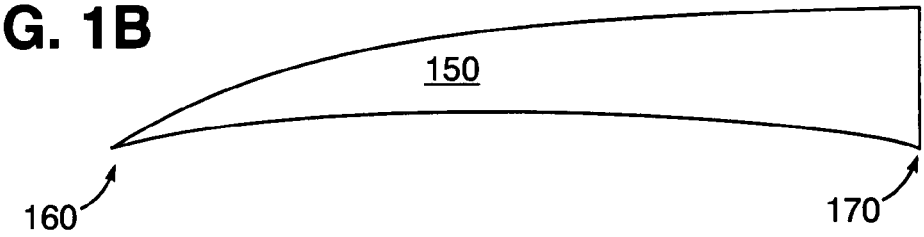
FIG. 1B is a prior art representation of a conventional blade section for propellers operating in a super-cavitating mode.

FIG. 3A shows the upper surface 310 having an upper convex portion 315. FIG. 3A also shows the lower surface having a lower convex portion 325, and a lower concave portion 327. As shown, the lower convex portion 325 and the lower concave portion 327 intersect along the lower surface 320 in a central zone 350. The upper convex portion 315 intersects with the lower convex portion 325 at the aft or trailing end 340 forming an aft or trailing edge 345. The upper convex portion 315 intersects with the lower concave portion 327 at the forward or leading end 330 forming a forward or leading edge 335. As shown in FIG. 3A, the trailing edge 345 is sharp as compared to the trailing edge in conventional super-cavitating blade sections illustrated in FIG. 1B.

FIG. 3A further shows a horizontal reference axis 360 extending from the leading edge 335 to the trailing edge 345. As illustrated, the upper convex portion 315 lies above the horizontal reference axis 360. The lower convex portion 325 lies below the horizontal reference axis 360. FIG. 3A shows the lower concave portion 327 substantially coinciding with the horizontal reference axis 360. However, as outlined below, the geometry of the advanced blade section 300 may vary according to operational requirements. Thus the camber of the lower concave portion 327 may vary according to requirements. Depending on the camber of the lower concave portion 327, portions of the lower concave portion 327 may lie above and/or below the horizontal reference axis 360. For example, FIG. 3E shows a blade section 300 having a camber such that the lower concave portion 327 lies entirely below the horizontal reference axis 360. As shown in FIG. 3A, 355 represents a location substantially halfway between the leading edge 335 and the trailing edge 345.

Figure 3B:
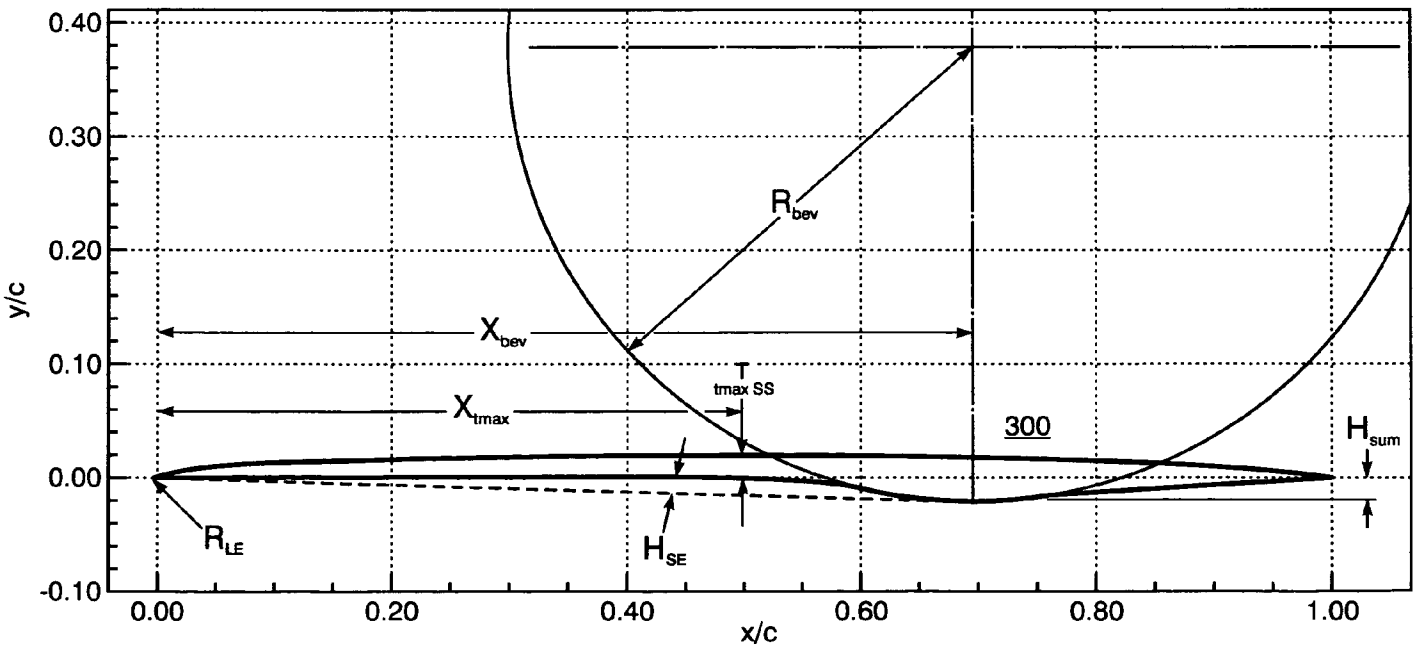
FIG. 3B is a representation of an advanced blade section including blade section variables for operating in both sub-cavitating and super-cavitating modes, according to an embodiment of the invention.

FIG. 3B is a representation of the blade section 300, showing blade section variables for operating in both sub-cavitating and super-cavitating modes, according to an embodiment of the invention. As shown in FIG. 3B, a geometric representation of the blade section 300 can be defined by seven parameters. According to these parameters, an upper side of the blade is defined by a leading edge radius, $R_{LE}$, at the leading edge 335. The leading edge radius $R_{LE}$ values determine the roundness of the blade section at the leading edge. Typically, a smaller $R_{LE}$ value produces a less rounded leading edge section. For example, as compared to the prior art leading edge illustrated in FIG. 1A, the blade section 300 in FIG. 3A has a smaller $R_{LE}$ value and is thus, less rounded than the prior art section. The upper side of the blade is further defined by a half-thickness, $T_{maxSS}$, measuring a thickness of the blade at a chord-wise position of $X_{tmax}$. In one embodiment, the chord-wise position $X_{tmax}$ may be at location 355, i.e., substantially halfway between the leading edge 335 and the trailing edge 345. A pressure side of the blade is developed based on the leading edge radius $R_{LE}$ at the leading edge 335, a transition/bevel radius, $R_{bev}$, a chord-wise position of the transition radius, $X_{bev}$, a height of the transition radius, $H_{sum}$, and a scale factor for the shape of the super-cavitating surface, $H_{sc}$.

Figure 3C:
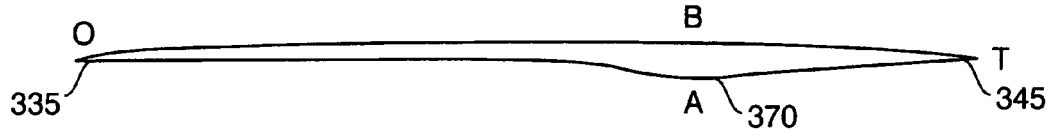
FIG. 3C is a representation of the blade section cavity flow at low speeds, according to an embodiment of the invention.
Figure 3D:
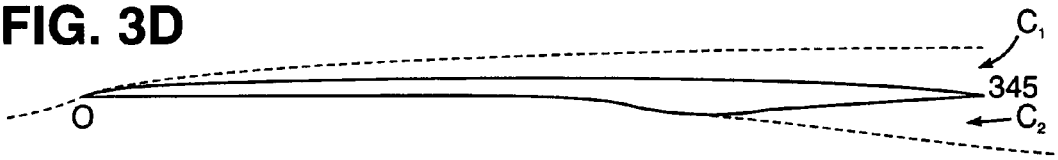
FIG. 3D is a representation of the blade section cavity flow at high speeds, according to an embodiment of the invention.
Figure 3E:
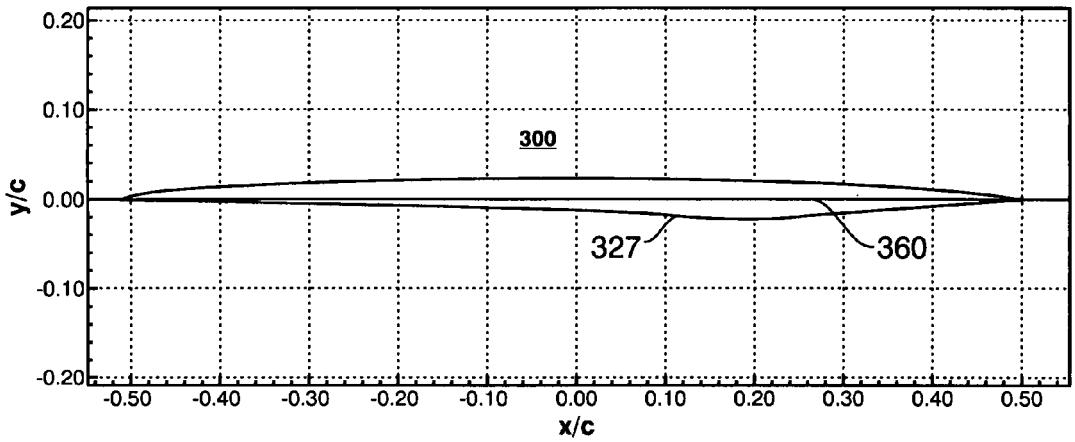
FIG. 3E is a representation of an advanced blade section for operating in both sub-cavitating and super-cavitating modes, according to an embodiment of the invention.

An optimization based design procedure is used to develop section shapes defined by the seven parameter model. According to the optimization procedure, the lift-to-drag ration can be maximized while key aspects of the blade section performance, such as lift, lift-to-drag ratio, lift coefficient, angle of attack, and structural strength, are assessed at different watercraft speeds against the design constraints. These aspects are assessed using a two-phase hydrodynamic analysis tool to determine how performance is governed by each parameter. For example, the bevel radius, $R_{bev}$, affects both the effectiveness of the pressure side camber parameter, $H_{sc}$, and assists in controlling the high velocity over the transition radius, which can cause flow separation or premature cavitation on the pressure side ramp region. Additionally, depending on the operating speed, the transition radius $X_{bev}$ may be pushed forward or back to improve efficiencies. Through the optimization process using the seven parameters, a blade section is generated to have an adequate leading edge radius $R_{LE}$ for the sub-cavitating mode operation at low speeds and thin enough to produce a thin leading edge cavity to achieve a high lift-to-drag ratio at high speeds. Furthermore, a thickened region 370 at the transition radius provides structural stiffness to the blade section. According to the seven parameter model, as shown in FIG. 3C, at low speeds, both upper and lower blade surfaces (310, 320) are designed to operate fully wetted and the boundary layer flow (OBT, OAT) is fully attached. At high speeds, as shown in FIG. 3D, only the front part of the lower surface of segment OA is designed to be fully wetted. The upper surface (OBT) and the rear part of the lower surface of segment AT is covered by vapor, or ventilated air-fill cavities $C_1$ and $C_2$.

Figure 4A:
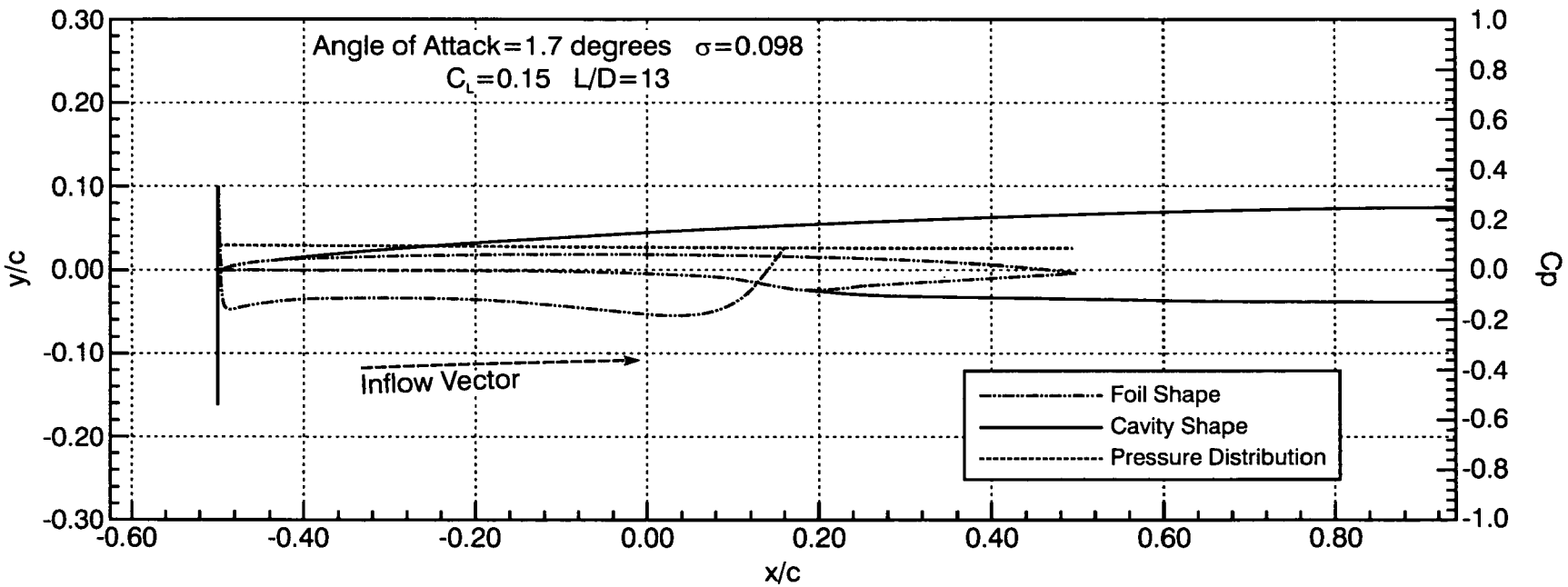
FIGS. 4A and 4B are graphical illustrations of blade section performance, according to embodiments of the invention.
Figure 4B:
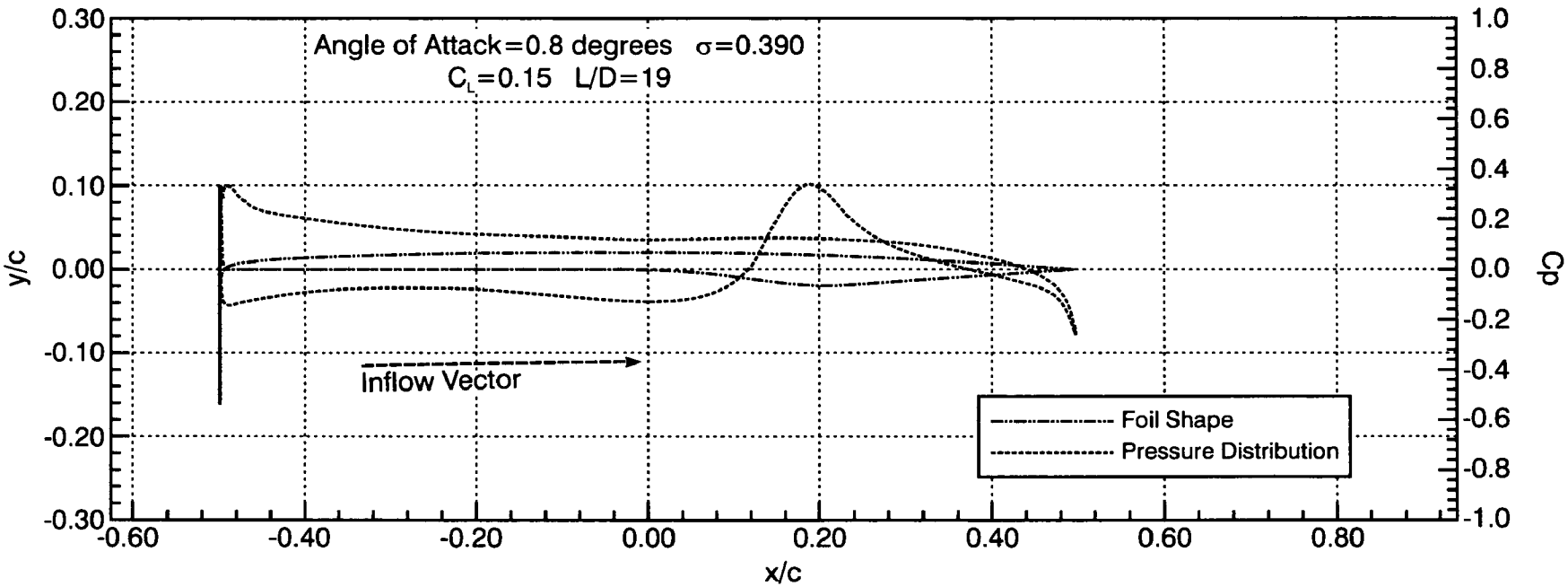

As an example, in an optimization based design procedure, given a 0.15 lift coefficient section operating on a propeller at 20 and 39 knots, a notional section is developed as follows. The new blade section requires an angle of attack change of only 3.8 degrees and has lift-to-drag ratios of 13 and 19 at the high and low speeds, respectively. The section shape, pressure distribution and cavity shapes of the section at the two operating conditions are shown in FIGS. 4A and 4B. At high speeds, the upper side cavity initiates from the leading edge 335 and extends over the upper surface 310. The pressure side cavity initiates at the transition radius on the lower surface 320. The trailing end 340 of the lower surface 320 is in the cavity. The calculated flows over the upper and lower surfaces at 20 knots are also shown in FIG. 4B. It is noted that the section 300 is absent of cavitation on both upper and lower surfaces at 20 knots.

Figure 5:
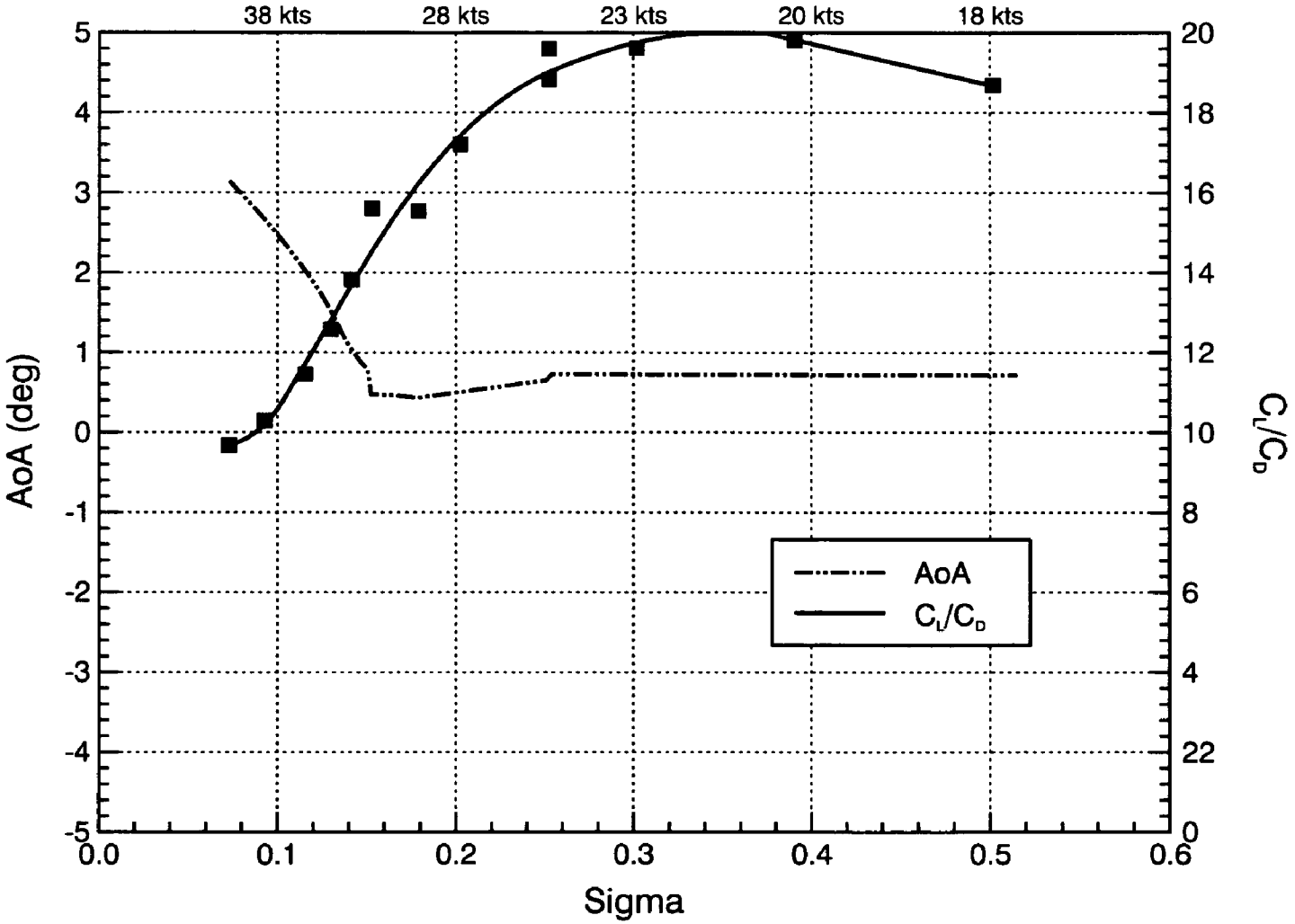
FIG. 5 is a graphical illustration of performance diagnostics, according to an embodiment of the invention.

According to the optimization based design procedure, FIG. 5 shows the lift-to-drag ratio and required angle of attack for the section to maintain a 0.15 lift coefficient over a range of cavitation numbers. At 20 knots there is no cavitation on the section. At a cavitation number of 0.30, or about 23 knots, a leading edge upper side cavity and a pressure side cavity at the transition radius begin to form. At about 29 knots, or a cavitation number of 0.17, the section has become super-cavitating but does not yet require any angle of attack to maintain the lift coefficient. At speeds above 32 knots, the angle of attack needs to increase to maintain the design lift. These results show an improvement over known blade sections.

It should be noted that based on operational requirements, any of the seven parameters $R_{LE}$, $T_{maxSS}$, $X_{tmax}$, $R_{bev}$, $X_{bev}$, $H_{sum}$, and $H_{sc}$, may be adjusted to achieve maximum efficiency. For example, as outlined above, depending on the operational speed, the transition/bevel radius $R_{bev}$ may be pushed forward or back. Although the present invention utilizes seven design parameters, more than seven or less than seven parameters may be used to define the profile of the blade sections. Additionally, design parameters may differ from those outlined above. Furthermore, depending on the size of the watercraft, the propeller sizes and accompanying advanced blade propeller sections may be increased or decreased to provide the desired thrust requirements. However, regardless of the size of the propeller, the general profile as illustrated in FIGS. 3A-3D is maintained.

Figure 6:
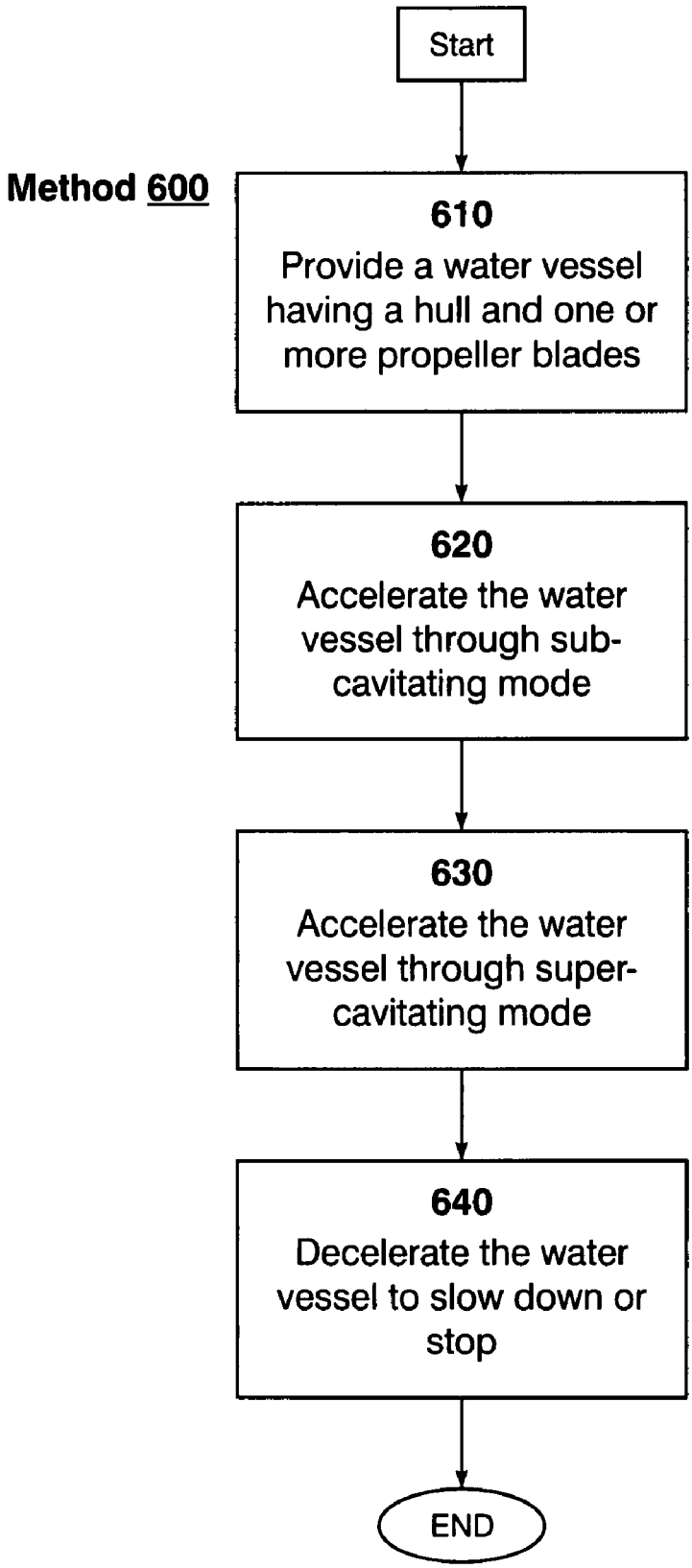
FIG. 6 is a flow chart of a method of accelerating and decelerating a water vessel in open water through sub-cavitating and super-cavitating modes, according to an embodiment of the invention.

FIG. 6 is a flow chart of a method of accelerating and decelerating a water vessel in open water through sub-cavitating and super-cavitating modes, according to an embodiment of the invention. Step 610 is the providing of a water vessel having a hull and one or more propeller blades. According to the method, each blade includes an advanced blade section having an upper surface and a lower surface, as previously outlined with respect to the description of FIGS. 3A and 3B.

Step 620 is the accelerating of the water vessel through a sub-cavitating mode by rotating the one or more propeller blades at accelerated angular velocities. The propeller blades are rotated in a first direction, wherein in the first direction the water flows from the leading edge to the trailing edge. As outlined above, in the sub-cavitating mode, the water vessel may travel from about 0 to about 30 knots. As shown in FIG. 3C, at the low speeds both the upper and lower surfaces are fully wetted and have a fully attached boundary layer flow.

At 630, the water vessel is accelerated through a super-cavitating mode by rotating the one or more propeller at accelerated angular velocities in the first direction. As outlined above, in the super-cavitating mode the water vessel may travel from about 30 to about 50 knots. According to this method, in the super-cavitating mode only a front part of the lower surface is fully wetted, as illustrated in FIG. 3D.

At 640, the water vessel is decelerated to bring the water vessel to a substantially stationary mode by producing a negative thrust by rotating the one or more propeller blades in the reverse direction. According to the method, in the reverse direction the water flows from the trailing edge to the forward edge in a smooth attached manner. As shown in FIGS. 3A and 3B, the smooth section profile at both leading and trailing ends enables the smooth flow of water over the blade section profile in both forward and reverse directions to provide the desired forward or backward thrust.

A number of exemplary implementations have been described. Nevertheless, it will be understood that various modifications may be made. For example, suitable results may be achieved if the steps of described techniques are performed in a different order and/or if components in a described component, system, architecture, or devices are combined in a different manner and/or replaced or supplemented by other components. Accordingly, other implementations are within the scope of the following claims.

What is claimed is:

1. A watercraft having:

a hull;

one or more propulsion units attached to the hull;

one or more propeller blades rotatably mounted on each said one or more propulsion units for operating in a sub-cavitating mode and a super-cavitating mode, each said blade comprising:

an advanced blade section comprising:

an upper surface; and a lower surface, the upper surface and the lower surface intersecting at a forward end and at an aft end, wherein the forward end has a forward edge and the aft end has an aft edge, the upper surface having an upper convex portion extending from the forward end to the aft end, and the lower surface having a lower convex portion and a lower concave portion, the lower concave portion and the lower convex portion intersecting at a central zone between the forward end and the aft end, wherein the upper and lower surfaces function to provide fully wetted flow over both the upper and lower surfaces at low speeds, and a partially wetted flow with only a front part of the lower surface fully wetted, at high speeds.

2. The watercraft of claim 1, wherein the lower convex portion intersects with the upper convex, portion at the aft end, and the lower concave portion intersects with the upper convex portion at the forward end.

3. The watercraft of claim 2, wherein the advanced blade section includes a horizontal reference axis extending from the forward edge to the aft edge, so that the lower convex portion lies below the horizontal reference axis, and depending on a camber of the lower concave portion, portions of the lower concave portion may lie above, below, or may substantially coincide with the horizontal reference axis.

4. The watercraft of claim 3, wherein the lower concave portion has a camber such that the lower concave portion substantially coincides with the horizontal reference line.

5. The watercraft of claim 3, wherein the upper convex portion lies above the horizontal reference axis, the upper convex portion having a maximum height above the horizontal reference axis at a location substantially halfway between the forward end and the aft end.

6. The watercraft of claim 5, wherein the lower face is generally S-shaped.

7. A method of accelerating and decelerating a water vessel in open water through sub-cavitating and super-cavitating modes, the method comprising:

providing a water vessel having a bull and one or more propeller blades, each blade having an advanced blade section having an upper surface and a lower surface, the upper surface and the lower surface intersecting at a leading end and at a trailing end, wherein the leading end has a leading edge and the trailing end has a trailing edge;

accelerating the water vessel through a sub-cavitating mode by rotating the one or more propeller blades at accelerated angular velocities in a first direction, wherein in the first direction water flows from the leading edge to the trailing edge, and wherein in the sub-cavitating mode both the upper and lower surfaces are fully wetted and have fully attached boundary layer flow;

accelerating the water vessel trough a super-cavitating mode by rotating the one or more propeller blades at accelerated angular velocities in said first direction, wherein in the super-cavitating mode only a front part of the lower surface is fully wetted;

decelerating the water vessel to bring the water vessel to reduce the speed of the vessel or to substantially stop the vessel by producing a negative thrust by rotating the one or more propeller blades in a second direction opposite the first direction, wherein in the second direction the water flows from the trailing edge to the leading edge in a smooth attached manner.

8. The method of claim 7, wherein in each advanced blade section the upper surface has an upper convex portion extending from the leading end to the trailing end, and the lower surface having a lower convex portion and a lower concave portion, the lower concave portion and the lower convex portion intersecting at a central zone between the leading end and the trailing end, and wherein the advanced blade section includes a horizontal reference axis extending from the leading edge to the trailing edge, so that the lower convex portion lies below the horizontal reference axis, and the upper convex portion lies above the horizontal reference axis, the convex portion having a maximum height above the horizontal reference axis at a location substantially halfway between the leading end and the trailing end.

9. The method of claim 8, wherein in the advanced blade section, the lower convex portion intersects the upper convex portion at the trailing end, and the lower concave portion intersects the upper convex portion at the leading end.

10. The method of claim 9, wherein in the sub-cavitating mode, the water vessel travels from about 0 knots to about 30 knots.

11. The method of claim 10, wherein in the super-cavitating mode, the water vessel travels from about 30 knots to about 50 knots.

12. A propeller blade for rotatably mounting to a watercraft propulsion device for rotating at angular velocities defining operation in a sub-cavitating mode and in a super-cavitating mode, the blade comprising:

an advanced blade section comprising:

an upper surface; and a lower surface, the upper surface and the lower surface intersecting at a leading end and at an trailing end, wherein the leading end has a leading edge and a leading edge radius defining the leading edge, and the trailing end has a trailing edge, the upper surface having an upper convex portion extending from the leading end to the trailing end, the upper surface defined by a maximum half thickness of the upper convex portion and the chordwise positioning of the maximum half thickness between the leading edge and the trailing edge, and the lower surface having a lower concave portion and a lower convex portion forming a transition region, the lower concave portion defined by said leading edge radius, a super-cavitating contour height of the concave portion and the lower convex portion defined by a bevel radius of the lower convex portion, a height of the lower convex portion, and chord-wise positioning of the lower convex portion, wherein the lower concave portion and the lower convex portion intersect at a smooth continuous central zone between the leading end and the trailing end.

13. The propeller blade of claim 12, wherein the lower convex portion intersects with the upper convex portion at the trailing end, and the lower concave portion intersects with the upper convex portion at the leading end.

14. The propeller blade of claim 13, wherein the upper convex portion lies above the horizontal reference axis.

15. The propeller blade of claim 12, wherein the advanced blade section includes a horizontal reference axis extending from the leading edge to the trailing edge, so that the lower convex portion lies below the horizontal reference axis, and depending on a camber of the lower concave portion, portions of the lower concave portion may lie above, below, or may substantially coincide with the horizontal reference axis.

16. The propeller blade of claim 15, wherein the lower concave portion lies below the horizontal reference axis.

17. The propeller blade of claim 15, wherein the lower concave portion has a camber such that the lower concave portion substantially coincides with the horizontal reference line.

18. The propeller blade of claim 15, wherein the lower surface is generally S-shaped.

19. The propeller blade of claim 18, wherein said maximum half thickness is at a location that is substantially halfway between the leading edge and the trailing edge.

* * * * *